US006041872A

United States Patent [19]

Holcomb

[11] Patent Number: 6,041,872

[45] Date of Patent: Mar. 28, 2000

[54] DISPOSABLE TELEMETRY CABLE DEPLOYMENT SYSTEM

[75] Inventor: David Joseph Holcomb, Sandia Park, N. Mex.

[73] Assignee: Gas Research Institute, Chicago, Ill.

[21] Appl. No.: 09/185,697

[22] Filed: Nov. 4, 1998

[51] Int. Cl.[7] ..... E21B 47/12; G01V 1/40; G01V 3/18

[52] U.S. Cl. ..... 175/40; 340/854.7; 340/854.9

[58] Field of Search ..... 175/40; 340/853.3, 340/854.4, 854.7, 854.9; 367/81, 82

[56] References Cited

U.S. PATENT DOCUMENTS 3,904,840 9/1975 Kostelnicek .
4,181,184 1/1980 Scherbatskoy .
4,534,424 8/1985 Ramsey .
4,770,034 9/1988 Titchener et al. ..... 73/151
4,828,051 5/1989 Titchener et al. ..... 340/50
4,891,640 1/1990 Ip ..... 340/853
5,363,095 11/1994 Normann et al. ..... 340/854.7
5,746,277 5/1998 Howell, Jr. .

*Primary Examiner*—David Bagnell
*Assistant Examiner*—Chi H. Kang
*Attorney, Agent, or Firm*—Pauley Petersen Kinne & Fejer

[57] ABSTRACT

A disposable telemetry cable deployment system for facilitating information retrieval while drilling a well includes a cable spool adapted for insertion into a drill string and an unarmored fiber optic cable spooled onto the spool cable and having a downhole end and a stinger end. Connected to the cable spool is a rigid stinger which extends through a kelly of the drilling apparatus. A data transmission device for transmitting data to a data acquisition system is disposed either within or on the upper end of the rigid stinger.

8 Claims, 4 Drawing Sheets

DISPOSABLE TELEMETRY CABLE DEPLOYMENT SYSTEM

BACKGROUND OF THE INVENTION

1. Field of the Invention

This invention relates to an improved apparatus for use in wellbore telemetry operations. More particularly, this invention relates to an improved cable system for obtaining real-time information about the drilling process and the formations being drilled, which real-time information is measured while drilling (MWD) and transmitted to the surface immediately at a rate high enough to support high data transmission rates such as video or televiewer systems.

2. Description of Prior Art

In the oil and gas industry, in particular, there is a great need for real-time information about the drilling process and the formations being drilled. Ideally, the information would be measured while drilling and transmitted to the surface immediately at a rate high enough to support video or televiewer systems. However, current data transmission rates using conventional technology are on the order of 1 to 10 bits per second which, nevertheless, generates a substantial amount of revenue for the measurement-while-drilling business. By increasing the data rates into the megahertz range, not only would there be significant economic implications, but such high data rates would enable the real-time use of virtually any instrumentation to observe the drilling process and surrounding formations.

A number of efforts have been made to solve the transmission rate problem for measurement-while-drilling systems. Even the obvious solution of connecting an electrical or fiber optic cable to the instrumentation package has been attempted. The difficulty with the obvious solution lies in arranging to thread and retrieve cable through thousands of feet of drill pipe under operating conditions. This becomes a very large logistics and material handling problem if standard cable is used. A cable guaranteed to survive and to be reusable is quite bulky. It must be strung through all of the pipe to be used before the drill string is assembled, or alternatively, connectors must be used at each end of each stand of pipe. This drastically reduces the operation speed and, thus, entails large costs for drilling rig time. Indeed, the difficulties are so severe that this approach is almost never used.

An additional problem associated with conventional wellbore telemetry systems is the reliability of the means for transmitting the information between the subsurface region of the wellbore and the surface locations around the wellbore. In particular, in rotary drilling, a borehole is advanced by rotating a drill string equipped with a drill bit. Sections of drill pipe, typically 30 feet in length, are added individually to the drill string as the borehole is advanced. It will be apparent to those skilled in the art that cabling for transmitting a signal between the subsurface and surface locations of a wellbore must be such as to permit the addition of individual pipe sections to the drill string. One early approach to this problem involved the use of a continuous cable adapted to be lowered inside the drill string and to make contact with a subsurface instrument. This technique, however, required withdrawing the cable each time a pipe section was added to the drill string.

More recent approaches have involved the use of special drill pipe equipped with data conductors. Each pipe section is provided with connectors that mate with connectors of an adjacent pipe section so as to provide a data transmission conduit across the joint. Disadvantages of this system include the need for special pipe sections and the difficulty of maintaining insulation of the electrical connectors at pipe section joints.

U.S. Pat. No. 3,904,840 teaches an apparatus having coiled conductors stored therein for use in a wellbore telemetry system. The apparatus includes a tubular container, an insulated electric conductor mounted in the container in a configuration which includes left-hand and right-hand coils, and means for dispensing the conductor from opposite ends of the container. The apparatus permits the conductor string to be lengthened as the drill string is lengthened.

U.S. Pat. No. 4,181,184 teaches a soft-wire conductor wellbore telemetry system in which a resilient conductor having an outer flexible insulating coating and an inner flexible conducting core is employed in a drill string to maintain an electric circuit between a subsurface and a surface location. The conductor is inserted into the drill string in a generally free-hanging, random fashion to store excess length of conductor which is utilized as the drill string is lengthened. The stored conductor is maintained in the drill string in a generally untangled state due to its kink-resistant mechanical and physical properties. In addition, the frictional drag of the flowing drilling fluid tends to straighten and disentangle the conductor.

U.S. Pat. No. 4,534,424 teaches a retrievable telemetry system for installing and retaining a conductor between a surface terminal and a subsurface location in a drill string in which one end of the conductor is lowered into the drill string and is anchored to the drill string of a subsurface location. The upper end of the conductor is taken in from the surface until the conductor is tensioned to a selected amount. The upper end of the conductor is then conducted to the surface terminal. As each drill pipe section is added to the drill string to advance the depth of the well, the tension of the conductor is controlled to reduce fatigue failure of the conductor. In accordance with one disclosed embodiment, the tension of the conductor is controlled by connecting a conductor section of a selected length between the surface terminal and the upper end of the conductor.

SUMMARY OF THE INVENTION

It is one object of this invention to provide a measurement-while-drilling telemetry system for providing real-time information about the drilling process and the formations being drilled which permits data transmission rates in the megahertz range.

It is another object of this invention to provide a measurement-while-drilling telemetry system which overcomes the problem of deployment discussed hereinabove associated with conventional wellbore telemetry systems.

It is yet another object of this invention to provide a measurement while drilling telemetry system utilizing data transmission cables which are substantially less expensive than data transmission cables utilized in conventional wellbore telemetry systems.

These and other objects of this invention are achieved by a disposable telemetry cable deployment system for facilitating information retrieval while drilling a well comprising a cable spool adapted for insertion into a drill string, an unarmored fiber optic cable spooled onto the spool cable and having a downhole end and a stinger end, a rigid stinger connected to the cable spool and extending though a kelly of a drilling apparatus, and data transmission means for transmitting data to a data acquisition system disposed on an upper end of the rigid stinger. The disposable telemetry cable deployment system of this invention enables deployment of a disposable telemetry cable in a drilling environment without impacting the drilling process. In addition, the cable, an unarmored fiber optic link, is light and compact, allowing easy handling on a drill rig floor by one person. And, a fiber optic cable provides a band-width of several megahertz for data transmission, thereby removing the data-transmission bottleneck imposed by conventional 10 bit per second data transmission cables for measurement-while-drilling telemetry systems. Deployment of the unarmored fiber optic cable is relatively simple, because the entire fiber link can be inserted into the drill string at once. Finally, unarmored fiber optic cable is relatively inexpensive compared to reusable logging cable employed in conventional telemetry systems.

A critical consideration for this invention compared to earlier attempts to insert cable into drill pipe is to consider the data transmission cable as a throw away item to be used once and then disposed of. Unlike conventional telemetry systems in which the cable must survive for extended periods of time and is typically retrieved from the wellbore, the cable of this invention has only to survive for a few hours and need not be retrieved, making it feasible to use unarmored fiber that is cheap and that can be wound into packages small enough to be threaded into the drill pipe during tripping-in without interfering with the drilling operation. In addition, the extreme lightness and compactness of the fiber cable spool makes it easy to manipulate compared to the massiveness of conventional reusable cable.

Several factors regarding optical fiber cable suggest its particular suitability for this invention. For a standard 245 micron diameter fiber, several thousand feet of fiber can be wound onto a spool a few inches in diameter in a layer a fraction of an inch thick and 1 or 2 feet long. Thus, the cable package, weighing a few pounds, can be fitted into the drill string without blocking mud flow. Because the entire cable package can be put into the drill string at one time, threading the cable through the drill string after tripping-in becomes possible.

A further benefit of using optical fiber cable, in addition to the large bandwidth afforded by such cable, is the fact that no physical connection to a data acquisition system at the surface of the wellbore is required in order for the data acquisition system to receive data transmitted through the fiber optic cable. As a result, no rotary connection is required at the top of the fiber optic cable to maintain its connection to a data acquisition system as is required by conventional wellbore telemetry systems.

Because the fiber optic cable utilized in the telemetry cable deployment system of this invention is considered to be disposable, in accordance with one embodiment of this invention, means for grinding the cable into fine particles which can be conveyed out of the wellbore by the mud, such as a mud-driven turbine which drives a set of grinding jaws, is located at some point below the termination of the downhole end of the fiber optic cable in the wellbore.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
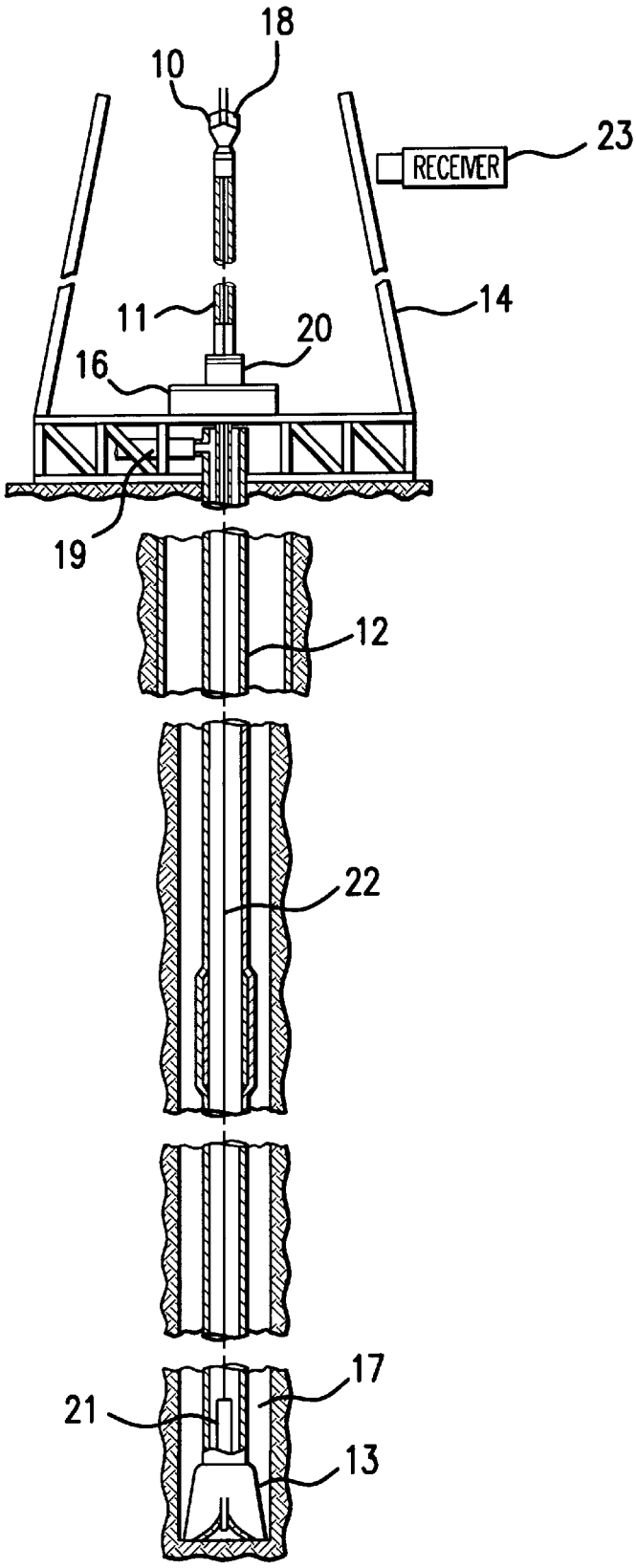
FIG. 1 is a schematic diagram of a well drilling apparatus provided with a telemetry system for monitoring a subsurface condition.

Rotary drilling equipment, as schematically shown in FIG. 1, includes swivel 10, kelly 11, tubular drill string 12, and drill bit 13. These components, connected as shown, are suspended from drilling derrick 14 by means of rig hoisting equipment. Kelly 11 passes through rotary table 16 and connects to the upper end of drill string 12. The term "drill string" as used herein refers to the column of tubular pipe 12 between bit 13 and kelly 11, and the term "pipe string" refers to the complete pipe column including kelly 11. The major portion of the drill string normally is composed of drill pipe with a lower portion being composed of drill collars. Drill string 12 comprises individual pipe sections connected together in end-to-end relation by threaded connections. In the lower portion of FIG. 1, the borehole and drill string diameters are enlarged in relation to the upper section to reveal further details.

Borehole 17 is advanced by rotating drill string 12 and bit 13 while at the same time drilling fluid is pumped through drill string 12 and up the borehole annulus. The drilling fluid is delivered to swivel 10 through a hose connected to connection 18 and is returned to the surface fluid system through pipe 19. A kelly bushing 20 couples rotary table 16 to kelly 11 and provides means for transmitting power from rotary table 16 to drill string 12 and bit 13.

As previously discussed, the object of a wellbore telemetry system is to monitor a subsurface drilling condition while drilling. This requires measuring a physical condition at the subsurface location, transmitting the data in some form, for example, in the instant case as an optical signal, to the surface, and reducing the signal to useful form. Situations in which telemetry systems are of particular use include drilling through abnormal pressure zones, drilling through zones where hole deviation is likely to be a problem, directional drilling, exploratory drilling, and the like.

Although the present invention may be employed in most any drilling operation in which a cable is used within a tubular pipe to transmit data between subsurface and surface locations, it is particularly useful in wellbore telemetry systems such as that shown in FIG. 1 comprising a measurement-while-drilling, or logging, package 21, a data conduit in the form of cable 22, and receiver 23. The measurement-while-drilling package 21 is capable of measuring a subsurface condition and enerating a suitable signal indicative of that condition and, as shown in FIG. 1, is disposed within drill string 12. The measurement-while-drilling package 21 may comprise a variety of devices having the capability of sensing physical conditions in the wellbore including transducers for measuring pressure, temperature, strain and the like, surveying instruments for measuring hole deviations, and logging instruments for measuring resistivity or other properties of subsurface formations. The measurement-while-drilling package 21 may be powered by batteries or by energy transmitted in the form of light through cable 22. Alternatively, a subsurface generator driven by fluid flowing through drill string 12 may be used to provide power to the measurement-while-drilling package 21.

The primary concern of this invention is a system for deploying a telemetry cable which is disposable, thereby greatly reducing the system cost compared to conventional telemetry systems, and which permits high data transmission rates between the subsurface and the surface in the megahertz range without significantly impacting or slowing the drilling operation.

Figure 2:
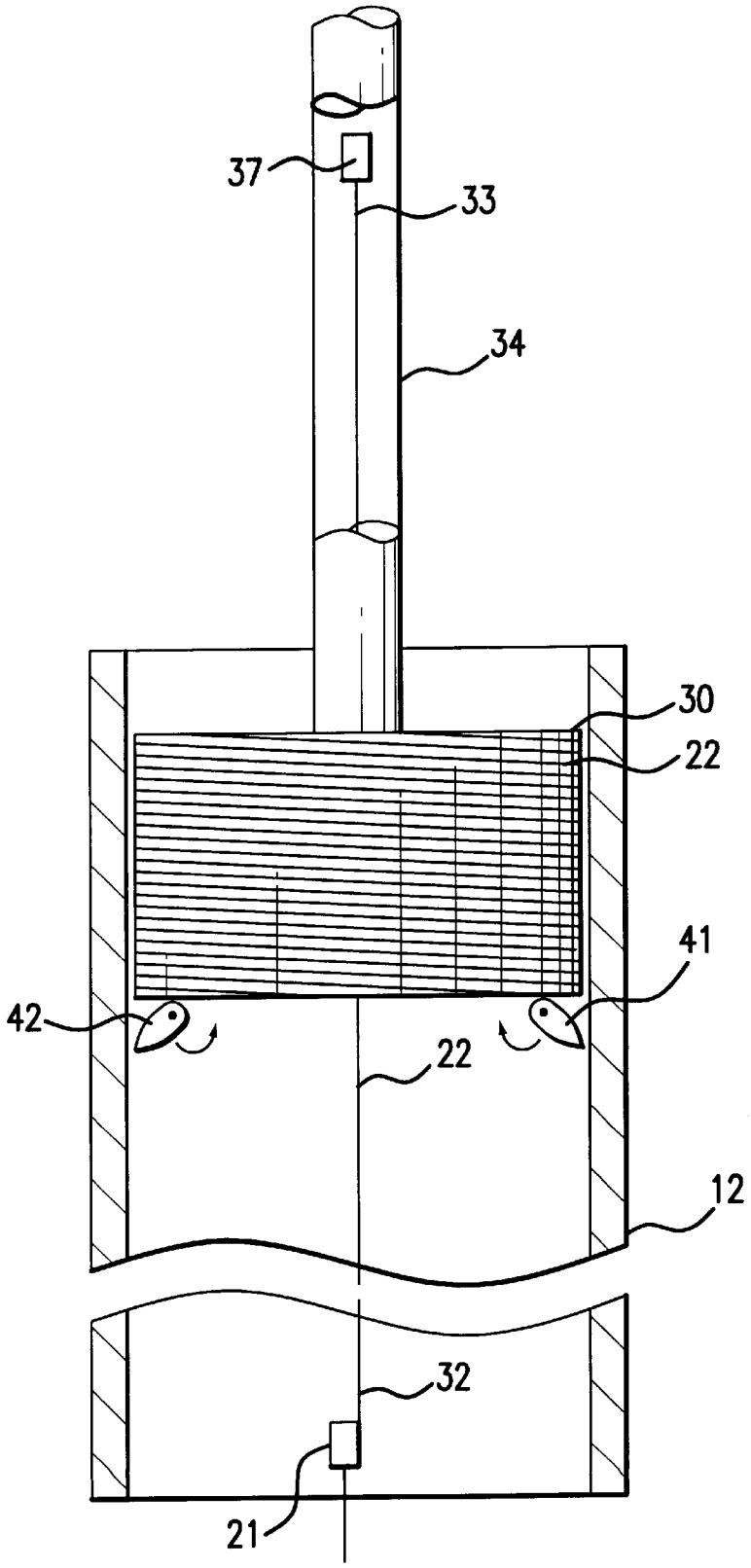
FIG. 2 is an enlarged partial cross-sectional view of a disposable telemetry cable deployment system disposed in a drill string in accordance with one embodiment of this invention.
Figure 3:
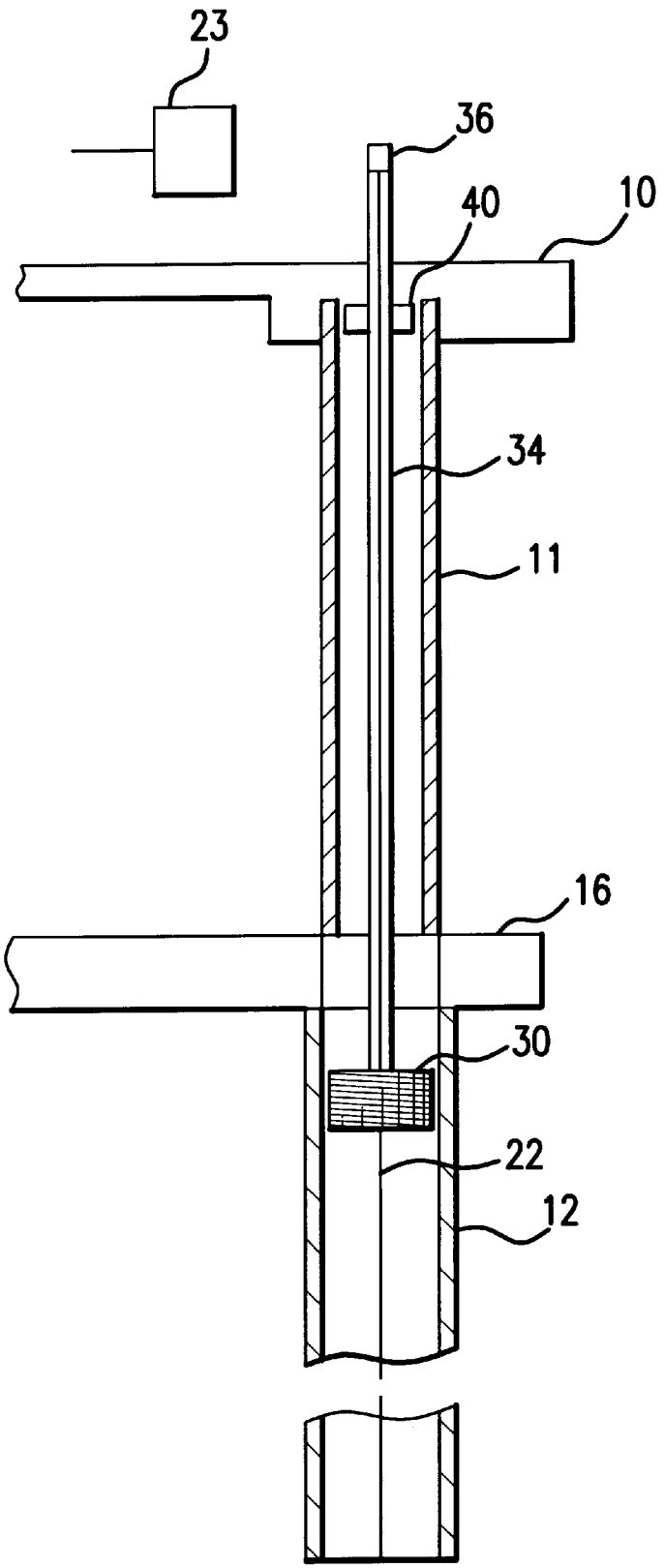
FIG. 3 is a schematic diagram of a disposable telemetry cable deployment system in accordance with one embodiment of this invention.

FIG. 2 shows a section of drill string 12 fitted with the disposable telemetry cable deployment system of this invention. As shown, the system comprises cable spool 30 adapted for insertion into drill string 12 onto which is spooled an unarmored fiber optic cable 22 having a downhole end 32 and a stinger end 33. Rigid stinger 34 is connected to cable spool 30 and extends through kelly 11 (shown in FIG. 1) of drilling derrick 14. Disposed at the top end of rigid stinger 34, as shown in FIG. 3, is data transmission means 36 from which a signal received by way of unarmored fiber optic cable 22 is transmitted to receiver 23 (shown in FIG. 1), which receiver 23 is a non-contacting receiver.

In accordance with one preferred embodiment of this invention, the data transmission means is in the form of a transmitter built into a "sub" 37, as shown in FIG. 2, disposed within rigid stringer 34, which transmitter transmits a signal through the walls of the rigid stringer 34 to the exterior thereof. In either case, no contact is required between receiver 23 and data transmission means 36, 37, thereby obviating the need for a rotary connection at the top of kelly 11. As shown in FIG. 2, all of the unarmored fiber optic cable to be deployed is insertable at one time into drill string 12 and only one connection of unarmored fiber optic cable 22 is required, that is connection to the measurement-while-drilling package 21. After insertion of cable spool 30, kelly 11 is reattached. Rigid stinger 34 which is connected to cable spool 30 serves to convey the signal transmitted through unarmored fiber optic cable 22 through kelly 11 and a rotating pressure seal 40 as shown in FIG. 3 in swivel 10 to the outside of drill string 12.

In accordance with one embodiment wherein data transmission means 37 is a "sub", the necessity for rigid stinger 34 to pass through rotating pressure seal 40 can be eliminated. Once inserted in drill string 12, cable spool 30 is protected from most of the hazards of a drill rig. Stinger 34 can also be used as a handle to raise cable spool 30 as stands of pipe are added during drilling. At the upper end of stinger 34, data transmission means 36 transmit data, either by light or radio (RF), to receiver 23. A non-contact data transmission/receiver system such as this avoids cables and connections on the rig floor.

The unarmored fiber optic cable is deployed by being pumped down drill string 12 along with the mud flow. Although a connection to the measurement-while-drilling package 21 by unarmored fiber optic cable 22 is preferred, such connection is not required. Rather, what is necessary is an information link. By arranging a mechanical stop or catcher at the measurement-while-drilling instrument package 21, a receiver connected to downhole end 32 of unarmored fiber optic cable 22 can be stopped within inches of a transmitter comprising measurement-while-drilling instrument package 21. Over such a short distance, either acoustic or electromagnetic fields can transmit a high-band width signal, avoiding the need for a complex and complicating connection.

In order to prevent cable spool 30 from being forced downward into drill string 12 while still enabling cable spool 30 to be moved freely up drill string 12, cable spool retention means for holding cable spool 30 are disposed within drill string 12. In accordance with one embodiment of this invention, cable spool 30 is held in place by spring-loaded camming feet 41, 42 as shown in FIG. 2. It will be apparent to those skilled in the art that alternative means for accomplishing this objective are available and should be considered to be within the scope of this invention.

Figure 4:
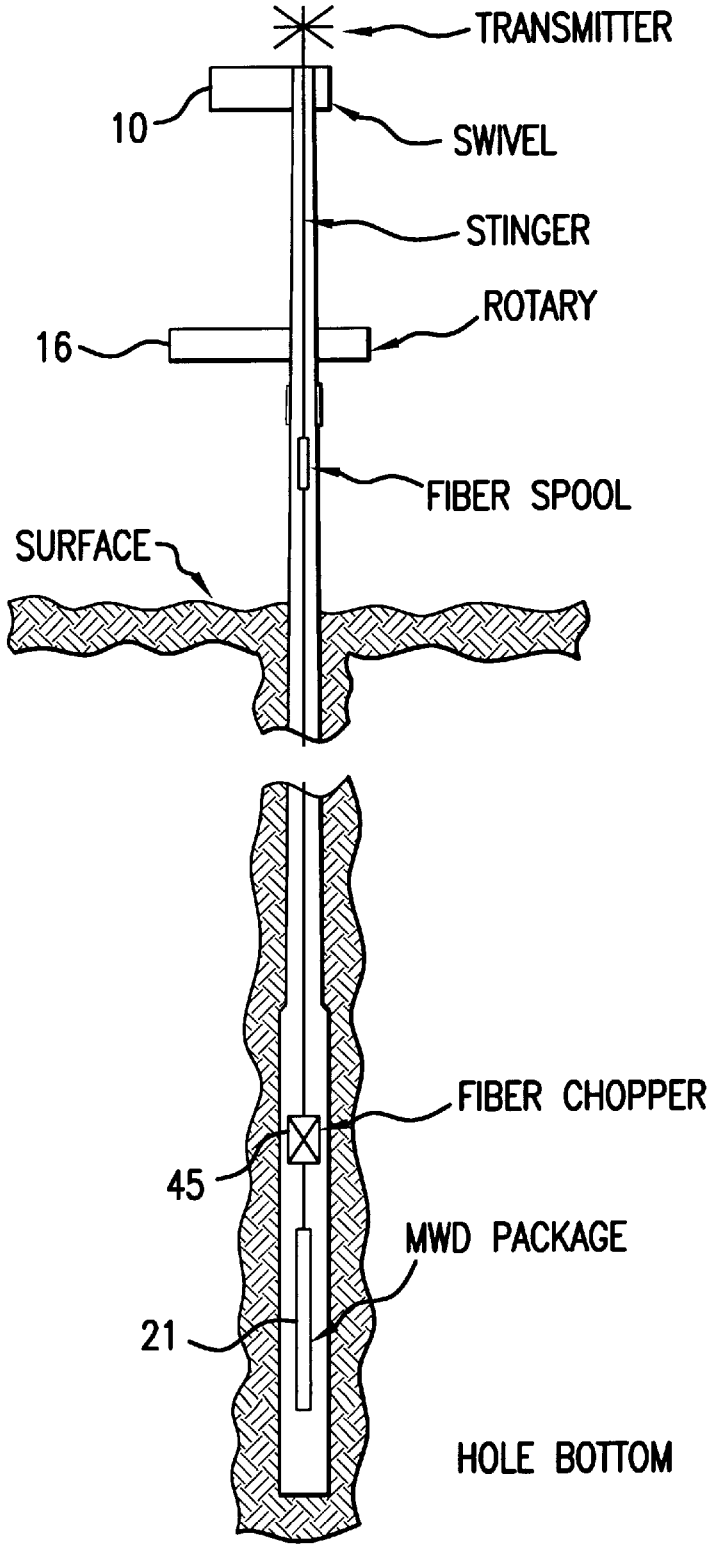
FIG. 4 is a general schematic diagram of a disposable telemetry cable deployment system in accordance with one embodiment of this invention.

In accordance with one preferred embodiment of this invention as shown in FIG. 4, provision in the form of fiber chopper 45 is provided within the wellbore for disposing of unarmored fiber optic cable 22 when drill string 12 is tripped out to change drill bit 13. In accordance with one preferred embodiment, fiber chopper 45 comprises a mud-driven turbine located at some point below where unarmored fiber optic cable 22 terminates, which drives a set of grinding jaws that convert the few pounds of silica fiber comprising said fibers optic cable into particles fine enough to be circulated out by the mud.

Because the fiber optic cable is unarmored, that is unprotected, there exists an issue regarding the ability of the optical fiber to survive for the required time in the environment of drill string 22. Areas of concern include abrasion due to the sand-laden drilling mud, chemical effects, pressure effects and drag on the fiber due to mud flow down drill string 22.

Laboratory testing has shown that commercially available fiber optic cable could withstand the anticipated drill string and mud environment. Abrasion tests in a flow simulator with mud deliberately loaded with sand to increase abrasivity found no damage to the nylon-coated fiber after 24 hours at realistic flow rates of 500 gpm. Tests were carried out at 5000 psi, 100° C., and a pH of 11 to show that the fiber could survive the chemical, pressure and temperature effects expected in a drill hole. Drag tests were conducted to determine the force on the fiber due to the mud flow in the drill string. For commercially available fibers, a useful strength is about 100 pounds.

Upon successful completion of the laboratory testing, an unarmored fiber optic cable was tested in the field. The fiber tested was a commercially available 400 micrometer diameter fiber. More than one kilometer of unarmored fiber, having a total weight of about 1 kilogram was deployed into the drill string. A continuous temperature log was transmitted from the downhole end of the fiber to the surface while mud was circulated at rates up to 550 gallons per minute.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A disposable telemetry cable deployment system for facilitating information retrieval while drilling a well comprising:

a cable spool adapted for insertion into a drill string:

an unarmored fiber optic cable spooled onto said cable spool and having a downhole end and a stinger end;

a rigid stinger connected to said cable spool and extending through a kelly of a drilling apparatus; and data transmission means for transmitting data to a data acquisition system, said means for transmitting data disposed either inside said rigid stinger or on an upper end of said rigid stinger.

2. A disposable telemetry cable deployment system in accordance with claim 1, wherein a receiver module is attached to said downhole end of said unarmored fiber optic cable.

3. A disposable telemetry cable deployment system in accordance with claim 1 further comprising cable disposal means for disposal of said unarmored fiber optic cable proximate said downhole end of said unarmored fiber optic cable.

4. A disposable telemetry cable deployment system in accordance with claim 3, wherein said cable disposal means is a fiber chopper suitable for converting said unarmored fiber optic cable to fine particles.

5. A disposable telemetry cable deployment system in accordance with claim 1, wherein said data transmission means comprises a non-contact transmission/receiver system.

6. A disposable telemetry cable deployment system in accordance with claim 5, wherein said non-contact transmission/receiver system is a light transmission system.

7. A disposable telemetry cable deployment system in accordance with claim 5, wherein said non-contact transmission/receiver system is an RF system.

8. A disposable telemetry cable deployment system in accordance with claim 1, wherein said cable spool is prevented from being forced down said drill string by cable spool retention means.

* * * * *